US006342331B2

(12) United States Patent
Oi

(10) Patent No.: US 6,342,331 B2
(45) Date of Patent: Jan. 29, 2002

(54) DIFFUSION TRANSFER FILM UNITS WITH TWO RECEIVING LAYERS

(75) Inventor: Nakao Oi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/729,961

(22) Filed: Dec. 6, 2000

(30) Foreign Application Priority Data

Dec. 7, 1999 (JP) ..... 11-348211

(51) Int. Cl.[7] ..... G03C 8/26; G03C 8/50; G03C 8/56

(52) U.S. Cl. ..... 430/207; 430/212; 430/213; 430/215; 430/216; 430/220; 430/227

(58) Field of Search ..... 430/212, 213, 430/214, 215, 207, 220, 227, 216

(56) References Cited

U.S. PATENT DOCUMENTS 2,647,049 A * 7/1953 Land ..... 430/207
2,972,532 A * 2/1961 Land ..... 430/244
2,977,226 A * 3/1961 Land ..... 430/207
3,316,090 A * 4/1967 Rogers ..... 430/213
3,620,731 A * 11/1971 Peisach ..... 430/212
3,721,556 A * 3/1973 Fix ..... 430/213
3,836,365 A * 9/1974 Reid ..... 430/212
3,930,864 A * 1/1976 Abel et al. ..... 430/213
4,379,828 A * 4/1983 Liebe et al. ..... 430/213
4,548,887 A * 10/1985 Helling et al. ..... 430/213
4,606,992 A 8/1986 Bishop ..... 430/220
4,720,446 A * 1/1988 Toriuchi et al. ..... 430/213
4,839,257 A 6/1989 Nakamura et al. ..... 430/207
4,992,353 A * 2/1991 Rodakis ..... 430/213
5,112,720 A * 5/1992 Karino ..... 430/213

* cited by examiner

*Primary Examiner*—Richard L. Schilling
(74) *Attorney, Agent, or Firm*—Sughrue Mion, PLLC

(57) ABSTRACT

The invention relates to a diffusion transfer type film unit which can produce the same two picture prints at one shot of photographing. The film unit comprises a first sheet and a second sheet. The first sheet includes at least transparent sheet through which exposure is made. The second sheet includes at least photosensitive layer.

In one embodiment, two dye image receiving layers are disposed on the first and second sheets separately and a peeling-off layer is disposed between the photosensitive layer and a dye image receiving layer on the second sheet.

In another embodiment, two dye image receiving layers are disposed on the same second sheet and a peeling-off layer is disposed therebetween.

In both embodiments, the second sheet is capable of being separated into two parts at the interface of the dye image receiving layer and the peeling-off layer. After development, respective picture images on the two dye image receiving layers can be viewed by separating the second sheet into two parts.

8 Claims, 3 Drawing Sheets

DIFFUSION TRANSFER FILM UNITS WITH TWO RECEIVING LAYERS

FIELD OF THE INVENTION

The invention relates to a diffusion transfer photographic film unit, particularly an integral type diffusion transfer photographic film unit which produces two prints of the same subject at one shot by peeling off the film unit.

BACKGROUND OF THE INVENTION

A conventional diffusion transfer color photographic film unit has roughly two types, a peel-apart type and a non-peel-apart type which is also called an integral type or mono-sheet type. In the peel-apart type, a photosensitive layer and a dye image receiving layer are coated on separate support materials respectively. The two supports are placed face to face after exposure is made and a processing liquid is spread between the two sheets to make development and transfer a dye image from the photosensitive layer onto the dye image receiving layer. Then the two sheets are separated to view the image on the image receiving layer on the one support.

Non-peel-apart type, which includes a dye image receiving layer and silver halide emulsion layers disposed between one transparent support and the other support, is classified into two types. In one of two type, the dye image receiving layer and the silver halide emulsion layer are coated on the same transparent support, a white reflective layer is disposed between the dye image receiving layer and the silver halide emulsion layer. In the other type, the two layers are coated on the two supports separately, a white pigment is contained in the processing liquid to be spread between the two layers to make it possible to view the formed image with reflected light.

In the non-peel-apart type, one of two sheets is unnecessary after having the image formed. In Japanese Patent Publication 90492/94 (tokko-hei 06-90492) and Japanese Patent Publication 100809/94 (tokko-hei 06-100809) show technologies to remove unnecessary photographic layers and a cover sheet by using a peeling-off layer.

However all the above mentioned conventional type of the diffusion transfer photographic film unit provides only one picture print from one film unit.

SUMMARY OF THE INVENTION

An object of the present invention is to provide a diffusion transfer photographic film unit which can make two picture prints at one shot.

One embodiment of the invention provides the film unit, which comprises a first sheet, a second sheet, and a rupturable pod containing a processing liquid which is ruptured after exposing to discharge the processing liquid between the first sheet and the second sheet to form a positive image, wherein the first sheet includes a peeling-off layer, a photosensitive layer and a first receiving layer, the peeling-off layer disposed between the photosensitive layer and the first image receiving layer, and the second sheet includes a second image receiving layer.

A modified film unit of the above have the first sheet including an adhesive layer to function as a sticker print for more fun and convenience to use the picture print.

Another embodiment of the invention provides the film unit, which comprises a first sheet, a second sheet, and a rupturable pod containing a processing liquid which is ruptured after exposing to discharge the processing liquid between the first sheet and the second sheet to form a positive image, wherein the first sheet includes a peeling-off layer, a first receiving layer and a second receiving layer, the peeling-off layer is disposed between the first image receiving layer and the second image receiving layer.

DETAILED DESCRIPTION OF THE INVENTION

Figure 1:
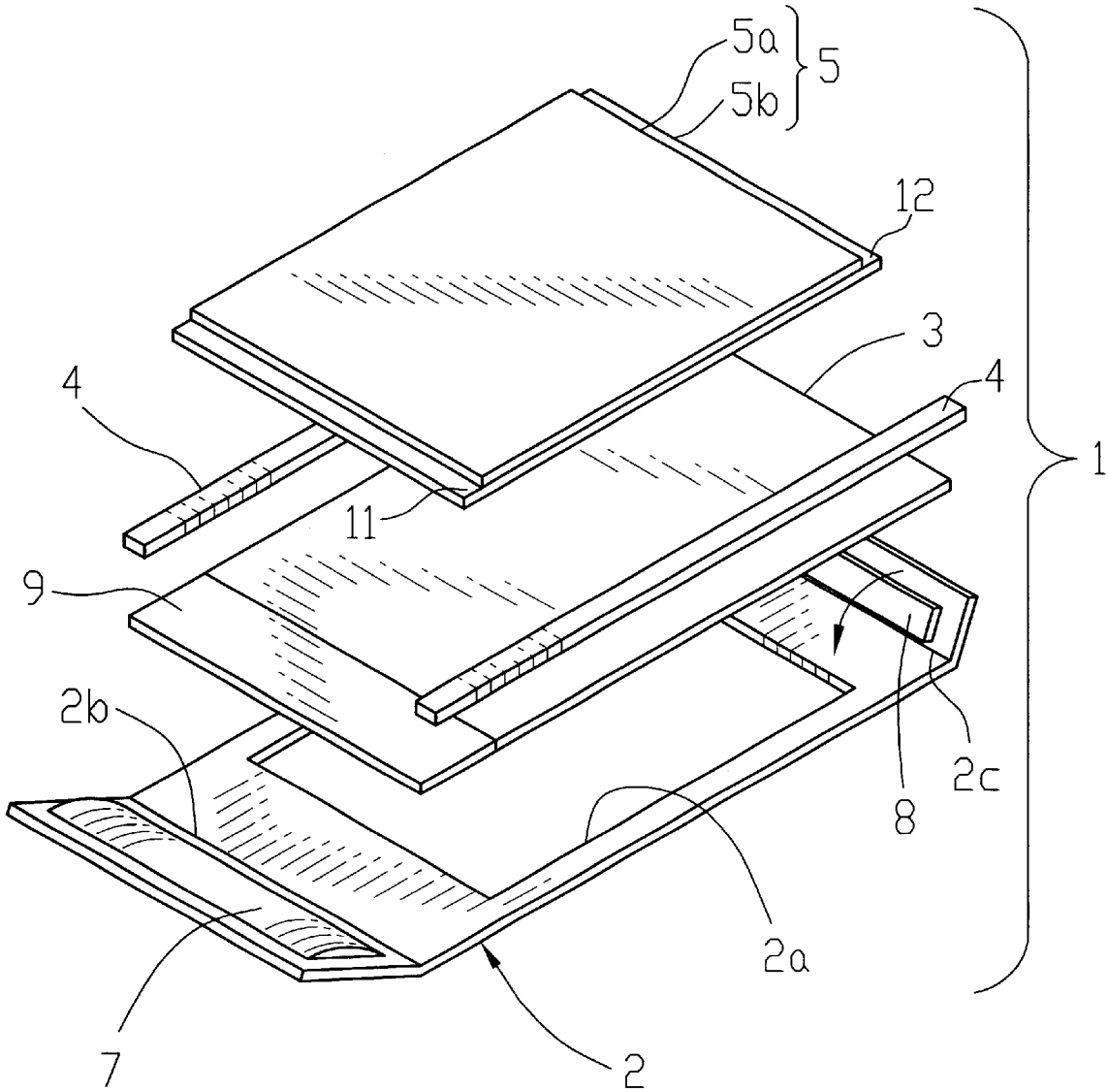
FIG. 1 shows an exploded perspective view illustrating the structure of the diffusion transfer photographic film unit of the invention.

As shown in FIG. 1, a diffusion transfer photographic film unit (hereinafter referred to simply as film unit) 1 is constituted with a mask sheet 2 which has an opening 2*a* for exposure in the middle, a first sheet 3 disposed on the mask sheet 1, a pair of spacer rail 4 and a second sheet 5. Those elements are layered and combined in order. A rupturable pod 7 containing processing liquid is fixed on one end portion(leading end portion), defined by a fold line 2*b*, of the mask sheet 2, and a trap member 8 for trapping excess amount of processing liquid is fixed on the other end portion(trailing end portion), defined by a fold line 2*c*, of the mask sheet 2.

The leading end portion of the mask sheet 2 is folded at the fold line 2*b* to be fixed to a step portion 11 of the second sheet 5 and the trailing end portion is folded at fold line 2*c* to be fixed to a step portion 12 of the second sheet 5. The second sheet is made of two sheets, upper side sheet 5*a* and lower side sheet 5*b*, which are separable. The upper side sheet 5*a* is not fixed to the mask sheet 2 so as to be easily peeled off after the development is made. A underlay 9 is fixed to the leading edge of the first sheet 3 to adjust the level gap between the rupturable pod 7 and one side of the first sheet 3 where the processing liquid spreads.

Figure 2:
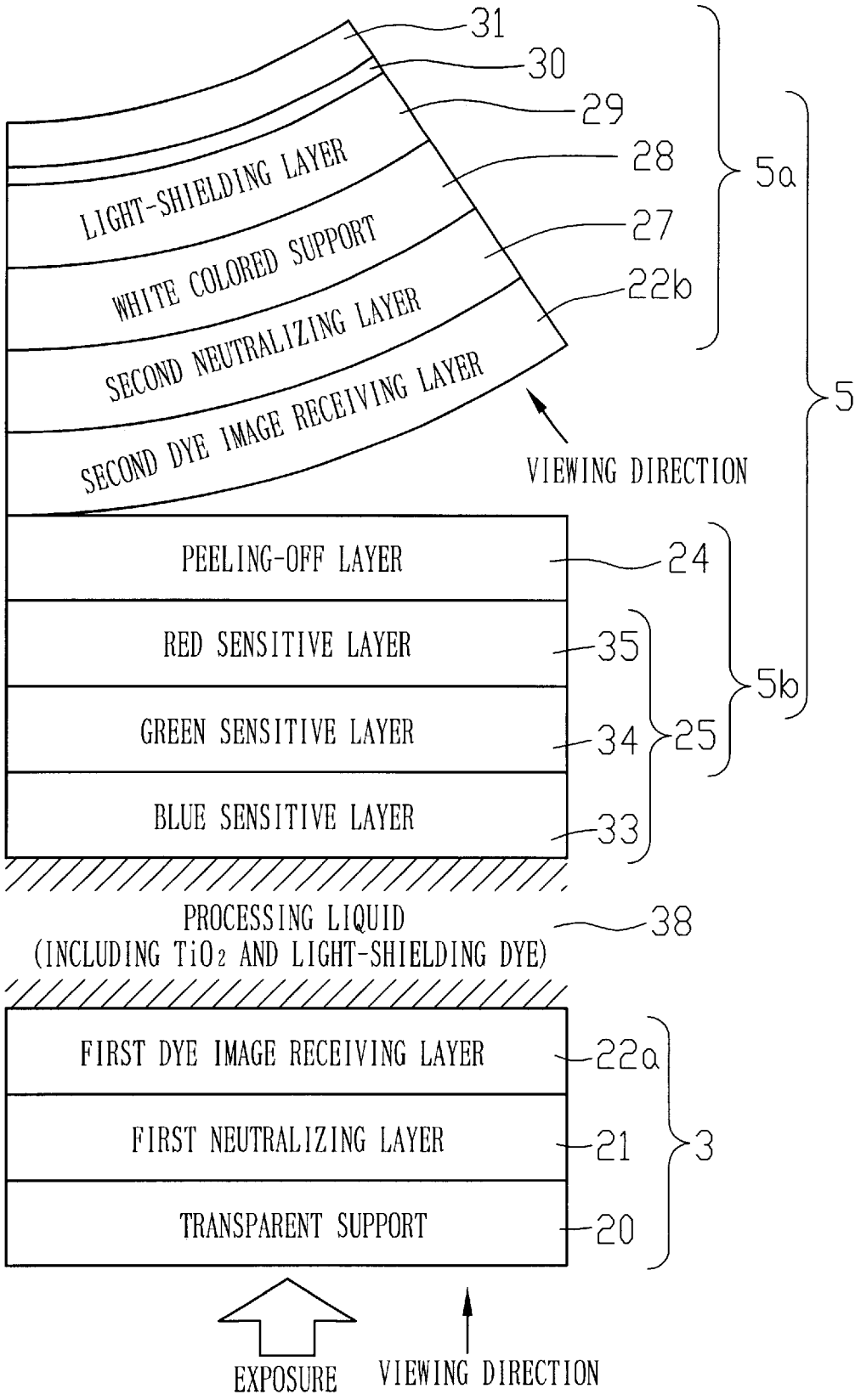
FIG. 2 shows explanatory diagram of the layers structure in the diffusion transfer photographic film unit of the first embodiment of the invention.

In FIG. 2 illustrating the layers structure of the first embodiment of the invention, a first sheet 3 includes a first neutralizing layer 21 and a first dye image receiving layer 22*a* are layered in order on a transparent support 20. A second sheet 5 includes a second dye image receiving layer 22*b*, a photosensitive layers 25 and a peeling-off layer 24 therebetween. A second neutralizing layer 27, a white colored support 28, a light-shielding layer 29, an adhesive layer 30 and a protective sheet 31 are layered in order on the second dye image receiving layer 22*b*. The photosensitive layers 25 include a blue-sensitive layer 33, a green sensitive layer 34 and a red sensitive layer 35 those of which produce yellow dye, magenta dye and cyan dye respectively after the development is made.

A processing liquid 38 for development is spread out after exposure of the film unit between the first sheet 3 and the second sheet 5 where the space is formed by the spacer rail 4. The processing liquid 38 includes a light-shielding dye and titanium dioxide (TiO2) which is capable of preventing the photosensitive layers 25 from extra exposure. After the development is completed, pH of the processing liquid become low, which turns the light-shielding dye into clear one. As a result of that, processing liquid finally forms white reflecting background layer for viewing the picture image on the image receiving layer.

A) Support

The white colored support of this invention requires enough whiteness to function as light reflecting layer when the picture on the dye image receiving layer is viewed and enough surface smoothness.

The following materials can preferably be used as the white colored support; for example, polymer films or synthetic paper, made of polymers such as polyethylene terephthalate, polystyrene, polypropylene, which are white-colored by adding white pigment such as titanium white or by forming micro-void by stretching, and laminated films including paper both side of which are laminated with polyethylene, polyethylene terephthalate or polypropylene which include titanium white.

The thickness of the support is between 50 μm and 350 μm, preferably between 70 μm and 210 μm and more preferably between 80 μm and 150 μm. If necessary light-shielding function can be provided to the support, for example, by laminating polyethylene film including a light-shielding agent such as carbon black on the back side of the white colored support.

B) Dye Image Receiving Layer

The dye image receiving layer of the invention includes a mordant in a hydrophilic colloid. The layer can be a single layer or multi-layers each of which has a different mordant with different dyeability. Japanese Laid-open Patent 252551/86 (tokkai-sho 61-252551)describes mordant. Polymer-type mordant is preferably used in the invention, such as polymers including a secondary and/or tertiary amino group, heterocycle with nitrogen, or those polymers with a quaternary cation group, molecular weight of which are more than 5,000, more preferably more than 10,000.

For example, U.S. Pat. Nos. 2,548,564, 2,484,430, 3,148,061, 3,756,814 show vinylpyridine polymer and vinylpyridinium cation polymer; U.S. Pat. No. 4,124,386 shows vinylmidazolium cation polymer; U.S. Pat. Nos. 3,625,694, 3,859,096, 4,128,538 and British Pat. No. 1277453 shows polymer-type mordant which is capable of bridging reaction with gelatin; U.S. Pat. Nos. 3,958,995, 2,721,852, 2,798,063, Japanese Laid-open Patent 115228/79 (tokkai-sho 54-115228), 145529/79 (tokkai-sho 54-145529), 126027/79 (tokkai-sho 54-126027), 155835/79 (tokkai-sho 54-155835) and 17352/81 (tokkai-sho 56-17352) show water-sol type mordants; U.S. Pat. No. 3,898,088 shows water-insoluble mordants; and U.S. Pat. Nos. 4,168,976 and 4,201,840 show reactive mordants which is capable of making covalent bond with dyes. Furthermore mordants disclosed in the following patents are also available;

U.S. Pat. Nos. 2,675,316, 2,882,156, 3,709,690, 3,788,855, 3,642,482, 3,488,706, 3,557,066, 3,271,147 and 3,271,148, Japanese Laid-open Patent 30328/78 (tokkai-sho 53-30328), 155528/77 (tokkai-sho 52-155528), 125/78 (tokkai-sho 53-125), 1024/78 (tokkai-sho 53-1024 and 107835/78 (tokkai-sho 53-1078359 and British Pat. No. 2064802.

C) Neutralizing Layer

A neutralizing layer used in the invention is a layer having enough acid to neutralize alkaline materials fed from the processing liquid, the layer can, if necessary, include multi-layers formed with a timing layer for adjusting neutralizing rate and a strengthening-bonding layer.

Preferable acid material for the layer is the one including acidic group whose pKa is equal to or less than 9, or precursor group capable of providing such acidic group by hydrolysis reaction. More preferable materials are a higher fatty acid such as oleic acid disclosed in U.S. Pat. No. 2,983,606; polymer of acrylic acid, methacrylic acid or maleic acid and partial esters thereof, or anhydrides thereof disclosed in U.S. Pat. No. 3,362,819; co-polymer of acrylic acid and acrylic acid ester disclosed in French Pat. No. 2290699; latex-type acidic polymer disclosed in U.S. Pat. No. 4,139,383 or "Research Disclosure" No. 16102 (1977); and acidic materials disclosed in U.S. Pat. No. 4,088,493, Japanese Laid-open Patent 153739/77 (tokkai-sho 52-153739), 1023/78 (tokkai-sho 53-1023), 4540/78 (tokkai-sho 53-4540), 4541/78 (tokkai-sho53-4541) and4542/78 (tokkai-sho 53-4542).

More concretely, following acidic polymers are available; co-polymer of vinyl monomer, such as ethylene, vinyl acetate, vinyl-methyl ether, and maleic acid anhydride; n-butyl ester of the co-polymer; co-polymer of butyl acrylate and acrylic acid; and cellulose acetate hydrogen phthalate.

Mixture of above mentioned acidic polymer and hydrophilic polymer is also available. As the hydrophilic polymer for this purpose, polyacrylamide polymethylpyrrolidone polyvinyl alcohol and partial saponification compounds thereof, carboxymethyl cellulose, hydroxymethyl cellulose and polymethylvinyl ether. polyvinyl alcohol is most preferable.

Coating amount of the acidic polymer depends on the amount of alkaline material spread over the photosensitive elements of the film unit. Ratio of chemical equivalent between the acidic polymer and the alkaline material is preferably between 0.9 and 2.0. In the case where the amount of acidic polymer is too short, a hue of the transferred dye may change or stain may appears in high-light or white image area. In the case of excess amount of acidic polymer, it also causes hue change or decrease of light stability of the image. More preferable range of the chemical equivalent ratio is between 1.0 and 1.3. Unmatched amount of the hydrophilic polymer to be mixed with the acidic polymer also causes loss of quality of picture image. Weight ratio between the hydrophilic polymer and the acidic polymer is between 0.1 and 10, more preferably between 0.3 and 3.0.

A variety of additives can be added into the neutralization layer of the invention, such as hardening agent to harden the layer; poly-hydroxyl compounds such as polyethylene glycol, polypropylene glycol and glycerin to improve the film brittleness; and other additives if necessary such as antioxidant, a fluorescent brightening agent or dye for bluing.

For the timing layer used in combination with the neutralization agent, following materials are available; polymer capable of reducing alkaline solution-permeability, such as gelatin, polyvinyl alcohol, partially acetalized material thereof, cellulose acetate, and partially hydrolyzed polyvinyl acetate; latex polymer capable of increasing activation energy for alkaline solution-permeability which is made by co-polymerization of small amount of hydrophilic co-monomer such as acrylic acid monomer; and polymer having lactone ring.

Preferable examples of those mentioned above are disclosed in the following patents; cellulose acetate is in Japanese Laid-open Patent 136328/79 (tokkai-sho 54-136328), U.S. Pat. Nos. 4,267,262, 4,009,030 and 4,029,849; latex polymer is in Japanese Laid-open Patent 128335/

79 (tokkai-sho 54-128335), 69629/81 (tokkai-sho 56-69629) and 6843/82 (tokkai-sho 57-6843), U.S. Pat. Nos. 4,056, 394, 4,061,496, 4,199,362, 4,250,243, 4,256,827 and 4,268, 604; and polymer having lactone ring is in U.S. Pat. No. 4,229,516. Other preferable polymers are disclosed in European Pat. No. 31957A1, 37724A1 and 48412A1.

Following patents and a literature also disclose available polymers; U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Pat. Application (OLS) No. 1622936 and 2162277 and "Research Disclosure" 15162 No. 151(1976).

The timing layer using those polymers is applicable as a single layer or multi-layers. The timing layer using those polymers can include development inhibitors or the precursors thereof disclosed for example in U.S. Pat. No. 4,009, 029, West German Patent Application (OLS)No. 2913164 and 3014672, and Japanese Laid-open Patent 155837/79 (tokkai-sho 54-155837) and 138745/80 (tokkai-sho 55-138745); and can also include hydroquinon precursor disclosed for example in U.S. Pat. No. 4,201,578; and/or other useful additives or the precursor thereof.

D) Light-shielding Layer

The development of the photographic film unit of the invention can be made even in a well-lighted place by preventing the photosensitive layers from being exposed to the ambient light by covering the photosensitive layers with a combination of a light-shielding layer and a processing liquid including light-shielding material to be spread over the exposed image area. The light-shielding layer is coated on the back of the support or between the support and the photosensitive layers, or is included in the support. As light-shielding materials, carbon black is preferably used among other materials capable of providing light-shielding property.

As binders for coating the light-shielding materials, gelatin is preferably used among other binders capable of dispersing carbon black.

More precisely, one side of the photosensitive layers is covered (light-shielded) with spread processing liquid including materials which has capability of light-shielding at least under high pH condition(at least until development is completed), the other side is covered (light-shielded) with the light-shielded layer or layers which is/are disposed between the photosensitive layers and a white colored support and/or within the white colored support and/or on the back side (opposite to photosensitive layers side) of the white support. It is not necessary to provide light-shielding by a single light-shielding layer. The plurality of the light-shielding layers disposed in different locations can function as a whole as a complete light-shielding element even if one of them does not have enough light-shielding function.

E) Peeling-off Layer

In the invention, a peeling-off layer is disposed between photosensitive layers 25 including a dye image-forming material and an image receiving layer 22 to enable to peel off a sheet 5*a* including the image receiving layer 22 from the film unit after the development is completed. The peeling-off layer has to function as bonding layer between the photosensitive layers 25 and the image receiving layer 22 before the developing starts and as peeling-off layer after developing is made.

The materials available for the peeling-off layer are disclosed in following patents; Japanese Laid-open Patent 8327/72 (tokkai-sho 47-8327), 220727/84 (tokkai-sho 84-220727), 229555/84 (tokkai-sho 59-229555), 4653/74 (tokkai-sho 49-4653), 4334/74 (tokkai-sho 49-4334), 65133/81 (tokkai-sho 56-65133) and 24075/70 (tokkai-sho 45-24075); and U.S. Pat. Nos. 3,220,835, 4,359,518, 3,227, 550, 2,759,825, 4,401,746 and 4,366,227. A water-soluble or alkaline-soluble cellulose derivatives are typical one of materials, such as hydroxyethyl cellulose, celluloseacetate-phthalate, plasticized methylcellulose, ethylcellulose, cellulose nitrate, carboxymethyl cellulose. As other materials, followings are available; natural polymers such as alginic acid, pectin and gum arabic, denaturated gelatin such as acetylated gelatin and phthalated gelatin, and water-soluble synthetic polymers such as polyvinyl alcohol, polyacrylate, polymethyl methacrylate and butylmethacrylate or co-polymers therefrom. As shown in Japanese Laid-open Patent 220727/84 (tokkai-sho 59-220727) and 60642/85 (tokkai-sho 60-60642), the peeling-off layer can be used as a single layer or a plurality of layers.

F) Photosensitive Layer

A photosensitive layer of the invention includes a dye image-forming material (1) The dye image-forming materials The dye image-forming materials used in the invention are non-diffusible compounds which are capable of discharging a diffusible dye of precursor thereof when silver is developed, or which turn into diffusible ones when silver is developed, which are shown in "The Theory of the Photographic Process" Version 4.

Those compounds are represented as following general formula;

$$\text{DYE-Y} \qquad \text{(I)}$$

wherein DYE represents dye or precursor thereof and Y represents an ingredient which is capable of providing a different diffusibility for the compounds under the alkaline condition. The compounds are divided into two types, according to the function of Y, negative-type compounds which turn into diffusible one at a silver developing site and positive-type compounds which turn into diffusible one at a silver non-developing site. The negative-type compounds which release the diffusible dye when silver is developed are shown in the following patents;

U.S. Pat. Nos. 3,928,312, 3,993,638, 4,076,529, 4,152, 153, 4,055,428, 4,053,312, 4,198,235, 4,179,291, 4,149,892, 3,844,785, 3,443,943, 3,751,406,3,443,939, 3,443,940, 3,628,952, 3,98,0479, 4,183,753, 4,142,891, 4,278,750, 4,139,379, 4,218,368, 3,421,964, 4,199,355, 4,199,354, 4,135,929, 4,336,322 and 4,139,389; and Japanese Laid-open Patent 50736/78 (tokkai-sho 53-50736), 104343/76 (tokkai-sho 51-104343), 130122/79 (tokkai-sho 54-130122), 110827/78 (tokkai-sho 53-110827), 12642/81 (tokkai-sho 56-12642), 16131/81 (tokkai-sho 56-16131), 4043/82 (tokkai-sho 57-4043), 650/82 (tokkai-sho 57-650), 20735/82 (tokkai-sho 57-20735), 69033/78 (tokkai-sho 53-69033), 130927/79 (tokkai-sho 54-130927), 164342/81 (tokkai-sho 56-164342) and 119345/82 (tokkai-sho 57-119345).

An example of preferable Y in negative-type dye-releasing redox compounds is N-substitution sulfamoyl group (N-substituent derived from aromatic hydrocarbon ring or heterocyclic ring). Other typical Y groups are shown as follows;

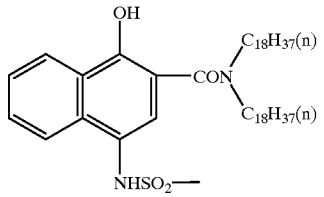

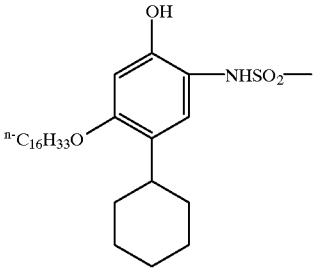

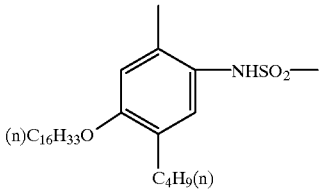

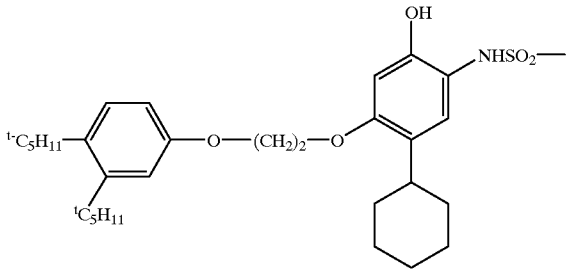

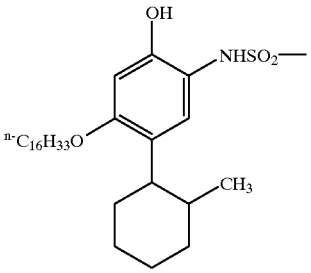

The positive-type compounds are described in "Angev. Chem. Inst. Ed. Engl., 22,191 (1982).

U.S. Pat. No. 2,983,606 discloses useful Y groups for the positive-type which turn into non-diffusible compounds from diffusible one under alkaline conditions after being oxidized by the development, which are known as dye developer.

U.S. Pat. Nos. 3,980,479, 3,421,964 and 4,199,355; and Japanese Laid-open Patent 69033/78 (tokkai-sho 53-69033) and 130927/79 (tokkai-sho 54-130927) discloses another example of Y group which provides compounds with function which disables the release of dye after being oxidized by the development, while it releases the diffusible dye by intramolecular ring closure under alkaline conditions.

There are some other compounds which releases dye when they are reduced. This type of compound is used in combination with an electron donor, which can release diffusible dye in an imagewise pattern by reacting with the electron donor oxidized in an imagewise pattern by silver development. Atomic groups having such function are shown in U.S. Pat. Nos. 4,183,753, 4,142,891, 4,278,750, 4,139,379, 4,218,368, 4,278,750, 4,356,249 and 4,358,525; Japanese Laid-open Patent 110827/78 (tokkai-sho 53-110827), 130927/79 (tokkai-sho 54-130927) and 164342/81 (tokkai-sho 56-164342); Japanese Technology Disclosure 6199/87 (koukai-gihou 87-6199); and European Pat. No. 220746A2.

Examples of the atomic groups are shown as follows;

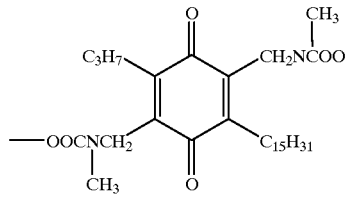

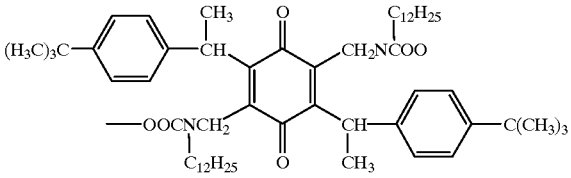

Above mentioned compounds are preferably used in combination with non-diffusible electron donor compounds (well-known as ED compounds)or precursor thereof. Examples of the ED compounds are disclosed in U.S. Pat. Nos.4,263,393 and 4,278,750; and Japanese Laid-open Patent 138736/81 (tokkai-sho 56-138736).

As different type of dye image-forming materials, the followings are available, and the details about those compounds are described in U.S. Pat. Nos. 3,719,489 and 4,098,783.

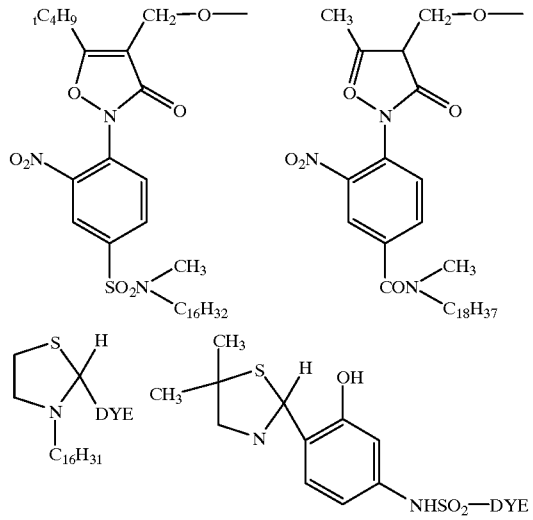

In these formulas, DYE represents the same dye or precursor as stated above.

Examples of the dye represented in general formula DYE are shown in the following patents.

Examples of yellow dye are disclosed in U.S. Pat. Nos. 3,597,200, 3,309,199, 4,013,633, 4,245,028, 4,156,609, 4,139,383, 4,195,992, 4,148,641, 4,148,643 and 4,336,322; Japanese Laid-open Patent 114930/76 (tokkai-sho 51-114930) and 71072/ 81 (tokkai-sho 56-71072); Research Disclosure 17630 (1978) and 16475 (1977).

Examples of magenta dye are disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; Japanese Laid-open Patent 106727/77 (tokkai-sho 52-106727), 23628/78 (tokkai-sho 53-23628), 36804/80 (tokkai-sho 55-36804), 73057/81 (tokkai-sho 56-73057), 71060/81 (tokkai-sho 56-71060) and 134/80 (tokkai-sho 55-134).

Examples of cyan dyes are disclosed in U.S. Pat. Nos. 3,482,972, 3,929,760, 4,013,635, 4,268,625, 4,171,220, 4,242,435, 4,142,891, 4,195,994, 4,147,544, and 4,148,642; British Pat. No. 1551138; Japanese Laid-open Patent 99431/79 (tokkai-sho 54-99431), 8827/77 (tokkai-sho 52-8827), 47823/78 (tokkai-sho 53-47823), 143323/78 (tokkai-sho 53-143323), 99431/79 (tokkai-sho 54-99431) and 71061/81 (tokkai-sho 56-71061); European Patent (EPC) 53037 and 53040; and Research Disclosure 17630 (1978) and 16475 (1977).

(2) Silver halide emulsion

Two types of emulsions are available in the invention; i.e. negative-type emulsion which forms latent image on the surface of silver halide grain and internal latent image type direct positive emulsion which forms latent image in the core of silver halide grain.

The internal latent image type direct positive emulsion has different types, for example, so-called conversion-type, which is made by using solubility difference in the silver halide, and core/shell-type which contains silver halide grains comprising a central core of silver halide doped with metal ions, chemically sensitized or a combination thereof and an outer shell of silver halide covering at least light-sensitive sites of the central core, which are described in following patents; U.S. Pat. Nos. 2,592,250, 3,206,313, 3,761,276, 3,935,014, 3,447,927, 2,497,875, 2,563,785, 3,551,662, 4,395,478 and 4,431,730; British Pat. No. 1027146; and West German Pat. No. 2728108.

It is necessary to form fog nuclei on the surface of the internal latent image type direct positive silver halide grain by using light or nucleating agents after image exposure. AS the nucleating agents, the following materials are available; hydrazine disclosed in U.S. Pat. Nos. 2,563,785 and 2,588,982; hydrazide and hydrazone disclosed in U.S. Pat. No. 3,227,552; heterocyclic quaternary salt compound shown in British Pat. No. 1283835; Japanese Laid-open Patent 69613/77 (tokkai-sho 52-69613); and U.S. Pat. Nos. 3,615,615, 3,719,494, 3,734,738, 4,094,683 and 4,115,122; sensitizing dye of which dye molecule has a substituent group capable of nucleating disclosed in U.S. Pat. No. 3,718,470; thiourea bonding-type acylhydrazine-based compounds sown in U.S. Pat. Nos. 4,030,925, 4,031,127, 4,245,037, 4,255,511, 4,266,013 and 4,276,364; and British Pat. No. 2012443; acylhydrazine-based compounds combined with heterocyclic ring of thioamide ring, triazole and tetrazole which functions as adsorbing group disclosed in U.S. Pat. Nos. 4,080,270 and 4,278,748; and British Pat. No. 2011391B.

In the invention, a spectral sensitizing dye is used in combination with the negative-type emulsion or internal latent image type direct positive emulsion, which is disclosed in the following patents and a literature; Japanese Laid-open Patent 180550/84 (tokkai-sho 59-180550) and 140335/85 (tokkai-sho 60-140335); Research Disclosure 17029; U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349.

(3) Structure of photosensitive layers

For reproducing natural colors by subtractive color process is used photosensitive layer(s) made of combination of emulsion spectrally sensitized by the spectral sensitizing dye aforementioned and a dye image-forming material capable of releasing the dye having spectral absorption in the same wave length range as the sensitized emulsion. The emulsion and the dye image-forming material can be coated as separate layers or coated as a single layer including a mixture of them. In the case where an actually coated dye image-forming material layer has a spectral absorption in the same range of wave length as the emulsion, separately formed coating layers are preferable. The emulsion layer can be divided into a plurality of layers each of which has a different light-sensitivity from each other or some other layer can be disposed between the emulsion layer and the dye image-forming layer. For example, Japanese Laid-open Patent 173541/85 (tokkai-sho 60-173541) shows the layer including a nucleating development accelerator, Japanese Patent Publication 15267/85 (tokko-sho 60-15267) shows separating layer for increasing a density of dye image and Japanese Laid-open Patent 91354/85 (tokkai-sho 60-91354) discloses a reflective layer to increase the photosensitive element.

In preferable multi-layered structure, blue-sensitive emulsion layer unit, green-sensitive emulsion layer unit and red-sensitive emulsion layer unit are disposed in order from exposure side. If necessary, an interlayer can be disposed between the emulsion layers, particularly it is useful for preventing emulsion layer unit from receiving undesirable influences coming from a developing process of other emulsion layer unit.

The interlayer preferably includes non-diffusible reducing agent to prevent an oxidized developing agent from diffusing when the developing agent is used in combination with non-diffusible type dye image-forming material. For that purpose, non-diffusible type hydroquinon, sulfonamide phenol and sulfonamide naphthol are available. Non-diffusible type reducing agent are disclosed in the following patents; Japanese Patent Publication 21219/75 (tokko-sho 50-21219), 23813/75 (tokko-sho 50-23813) and 18978/85 (tokko-sho 60-18978), Japanese Laid-open Patent 106329/74 (tokkai-sho 49-106329), 129535/74 (tokkai-sho 49-129535), 106329/82 (tokkai-sho 57-24941) and 21249/83 (tokkai-sho 58-21249); U.S. Pat. Nos. 2,336,327, 2,360,290, 2,403,721, 2,554,640, 2,732,300, 2,782,659, 2,937,086, 3,637,393 and 3,700,453; and British Pat. No. 557750.

A dispersing method about the non-diffusible reducing agents are described in Japanese Laid-open Patent 238831/85 (tokkai-sho 60-238831) and Japanese Patent Publication 18978/85 (tokko-sho 60-18978).

It is preferable to include compounds to supplement silver ion in the interlayer in case of using compound from which diffusible dye can be released by silver ion as shown in Japanese Patent Publication 7576/80 (tokko-sho 55-7576). If necessary, anti-irradiation layer, separating layer and/or protective layer is/are disposed.

G) Processing Liquid

A processing liquid used in the invention includes an alkali, a developing agent, a light-shielding agent, a viscosity-increasing agent, a development accelerator, a development inhibitor, an antioxidant and so on. The processing liquid is spread over the exposed image area to develop the exposed photosensitive layers while covering them to prevent from further exposure at least until completion of development in cooperation with a light-shielding layer disposed in the opposite side of the photosensitive layers.

The alkali is capable of providing 12 to 14 of pH value for a solution thereof, for example, hydroxide of alkaline metals such as sodium hydroxide, potassium hydroxide or lithium hydroxide; phosphate of alkaline metals such as potassium phosphate; guanidine; or hydroxide of quaternary amine such as tetra-methylammonium hydroxide. Sodium hydroxide and potassium hydroxide are preferable ones.

The viscosity-increasing agent is useful both for spreading the processing liquid uniformly between the two sheets and for keeping bonding two layers adjacent thereto when the film unit is separated into two parts. As the viscosity-increasing agent, for example, polyvinyl alcohol, hydroxyethyl cellulose and alkaline metal salts of carboxymethyl cellulose, preferably hydroxyethyl cellulose and sodium carboxymethyl cellulose are used. As the light-shielding material, typically used are carbon black or a combination of titanium white and temporarily-light-shielding dye which is capable of turning into colorless one when pH value lowers some time after the development.

Any developing agents which can cross-oxidize the dye image-forming materials and still produce little stain can be employed in this invention. A single development agent, a combination of different developing agents or precursor thereof can be used. Such developing agents may be incorporated in alkaline processing compositions (processing elements) or in appropriate layers of photo-sensitive elements. Examples of developing agents available in this invention are aminophenols or pyrazolidinones. More preferable because of less producing stain are pyrazolidinones such as 1-phenyl-3-pyrazolidinone, 1-p-tolyl-4,4-dihydroxymethy-3-pyrazolidinone, 1-(3'-methyl-phenyl)-4-methyl-4-hydroxymethyl-3-pyrazolidinone, 1-phenyl-4-methyl-4-hydroxymethyl-3-pyrazolidinone and 1-p-tolyl-4-methyl-4-hydroxymethyl-3-pyrazolidinone.

H) Cover Sheet and Others

A transparent cover sheet is used for spreading the processing agent uniformly over the photosensitive layers in the invention. A first sheet 3 in FIG. 1 works as the cover sheet. The cover sheet is separated together with the photosensitive layers and the layer made by processing liquid from the rest of the film unit after the development is completely made. Therefore making surface treatment of or having an appropriate bonding layer on the cover sheet in advance is preferred to keep bonding between the cover sheet and the layer made by processing liquid. It is possible to adjust sensitivity of the photosensitive layers by having a filtering dye in the cover sheet or a filtering dye layer on the cover sheet.

As transparent support 20, 20*a* of cover sheet, any transparent and smooth-surface support normally used for photographic products is also available. Examples of the supports are cellulose acetate, polystyrene, polyethylene terephthalate and polycarbonate with/without substratum used usually for the photographic products. If possible it is preferable that the cover sheet does not have a neutralizing layer.

Figure 3:
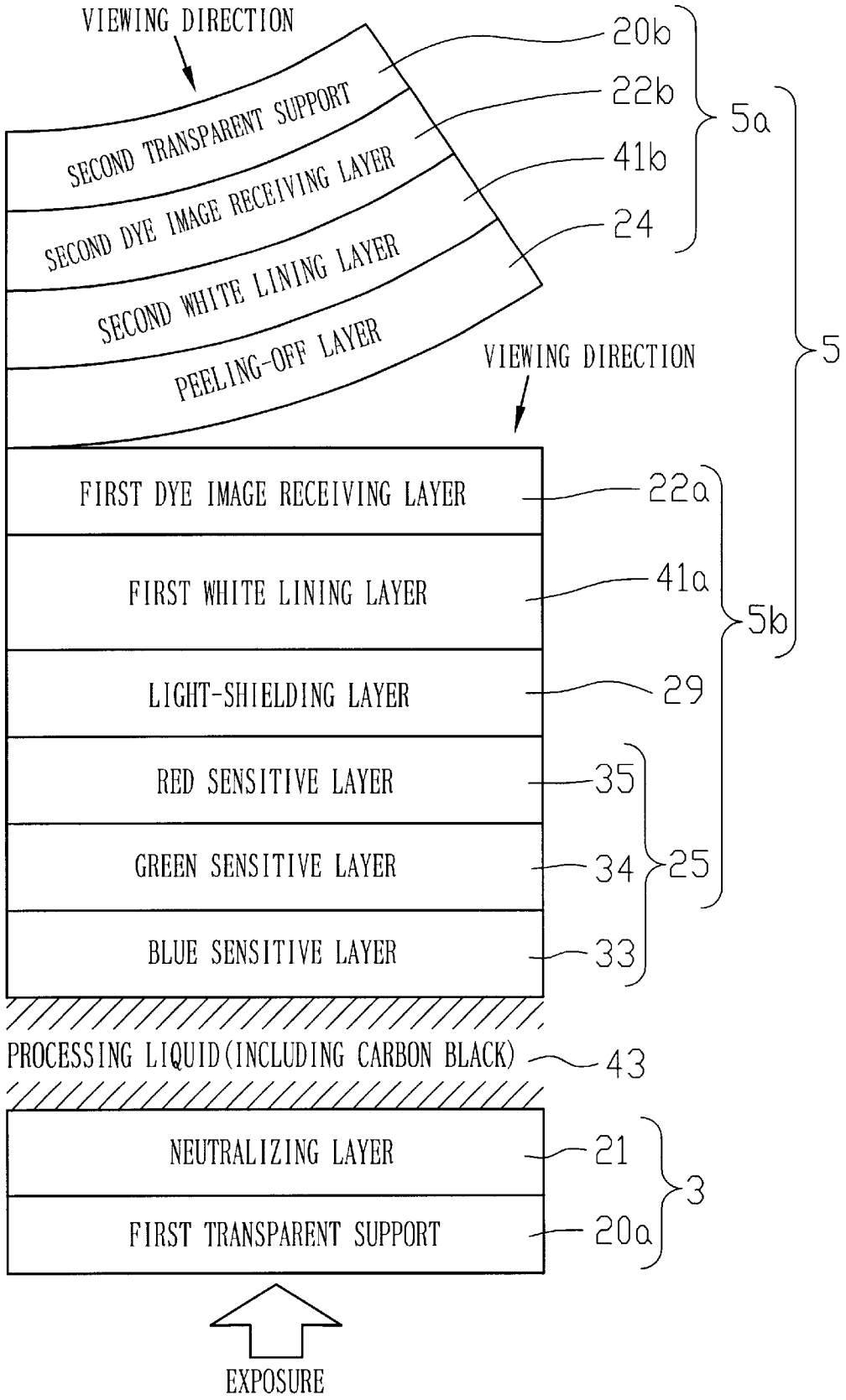
FIG. 3 shows explanatory diagram of the layers structure in the diffusion transfer photographic film unit of the second embodiment of the invention.

The film unit 1 constituted from the elements mentioned above is exposed from the side f mask sheet 2 (from bottom side in FIG. 2 and FIG. 3). In FIG. 1 and FIG. 2, rays of light through the exposure opening 2*a* reaches photosensitive layers 25 after passing through a transparent support 20, a first neutralizing layer 21 and a first dye image receiving layer 22*a*, where latent images are formed in a blue-sensitive layer 33, a green-sensitive layer 34 and a red-sensitive layer 35 respectively. Then well-known film unit transporting mechanism works to transport the film unit toward the bite of a pair of pressure applying rolls by picking the film unit stacked in a cartridge by a picking-claw. A rupturable pod 7 at the leading end of the film unit is ruptured by the pressure applying rolls to spread the processing liquid between a first sheet 1 and a second sheet 5 while the film unit is transported to emerge from the camera.

The film unit 1 emerged from the camera is exposed to ambient light, but the photosensitive layers 25 of the film unit is prevented from further exposure because the processing liquid 38 includes a light-shielding dye and titanium dioxide. After a predetermined time, a dye image is formed in the photosensitive layers 25 and then they are transferred to both the first dye image receiving layer 22*a* and a second dye receiving layer 22*b* respectively to form prints there.

At a step portion 11 or 12 of a second sheet 5, one edge of the sheet 5*a* is picked and peeled off from a sheet 5*b* by fingers or the like. The sheets 5*a* and 5*b* are separated at the interface between a peeling-off layer 24 and the second dye image receiving layer 22*b*, and a positive dye image formed on the second dye image receiving layer 22*b* becomes to be viewed. Also the same positive dye image formed on the first dye image receiving layer 22*a* becomes to be viewed in the exposure opening 2*a* through the transparent support 20 (cover sheet) on the background of the layer made of light reflective titanium dioxide and colorless dye formed from the processing liquid 38.

A light-shielding dye originally included in the processing liquid is capable of turning to be colorless when pH value decreases. Thus the film unit of the invention can make two picture prints at the same time of photographing. An adhesive layer 30 is disposed under a protective sheet 31 enables the picture print on the sheet 5*a* to be a sticker print after peeling off the protective sheet 31 and sticking and peeling the print can be repeated when a long-term sticking agent is applied.

SECOND EMBODIMENT

FIG. 3 shows layered structure of the film unit in the second embodiment of the invention. A first sheet 3 consists of a first transparent support 20*a* bearing only a neutralizing layer 21. A second sheet 5 of the film unit has two dye image receiving layers, the first one 22*a* and the second one 22*b*, between which a peeling-off layer is disposed. A upper portion of the second sheet 5, that is the sheet 5*a*, includes the peeling-off layer 24, a second white lining layer 41*b* on top of that, the second dye image receiving layer 22*b* and a second transparent support 20*b* in order. A lower portion of the second sheet 5, that is the sheet 5*b*, includes photosensitive layers 25, a light-shielding layer 29 on top of the layers 25, a first white lining layer 41*a* and a first dye image receiving layer 22*a* in order.

A processing liquid layer 43 spread between the first sheet 3 and the photosensitive layers 25 includes carbon black which has light-shielding function during and after the development.

When the film unit above mentioned is exposed and developed, a positive picture image emerges on the second dye image receiving layer 22*b*, which can be viewed from the second transparent support 20 therethrough. Same picture image also can be viewed on the first dye image receiving layer 22*a* on the lower sheet 5*b* of the second sheet 5 of the film unit by peeling off the upper sheet 5*a*.

The invention described above can be applied to, needless to say, black and white film unit.

What is claimed is:

1. A diffusion transfer photographic film unit comprising:

a first sheet;

a second sheet; and a rupturable pod containing a processing liquid which is ruptured after exposure to discharge the processing liquid between the first sheet and the second sheet to form positive images;

wherein the first sheet includes a transparent support, a first neutralizing layer and a first image receiving layer, and the second sheet includes a white colored support, a second neutralizing layer, a second image receiving layer, a peeling-off layer, and a photosensitive layer, the peeling-off layer being disposed between the photosensitive layer and the second image receiving layer.

2. A diffusion transfer photographic film unit as defined in claim 1, wherein the processing liquid forms into a white reflecting background layer of the first image receiving layer, and the white colored support forms into a white reflecting background layer of the second image receiving layer.

3. A diffusion transfer photographic film unit as defined in claim 2, further comprising a light-shielding layer on the back of the white colored support.

4. A diffusion transfer photographic film unit as defined in claim 1, wherein the second sheet includes an adhesive layer to function as a sticker print.

5. A diffusion transfer photographic film unit comprising:

a first sheet including a first transparent support;

a second sheet including a photosensitive layer, a peeling-off layer, a first image receiving layer, a second image receiving layer, and a second transparent support, the peeling-off layer being disposed between the first image receiving layer and the second image receiving layer; and a rupturable pod containing a processing liquid which is ruptured after exposure to discharge the processing liquid between the first sheet and the second sheet to form a full color positive image in the first image receiving layer and a full color positive image in the second image receiving layer.

6. A diffusion transfer photographic film unit comprising:

a first sheet;

a second sheet including a first image receiving layer, a photosensitive layer disposed between the first image receiving layer and the first sheet, a second image receiving layer, a peeling-off layer disposed between the first image receiving layer and the second image receiving layer such that the first image receiving layer is disposed between the peeling off layer and the photosensitive layer, and a white lining layer in the opposite side of the peeling-off layer to the first receiving layer; and a rupturable pod containing a processing liquid which is ruptured after exposure to discharge the processing liquid between the first sheet and the second sheet to form positive images.

7. A diffusion transfer photographic film unit comprising:

a first sheet;

a second sheet having a photosensitive layer facing the first sheet, at least two image receiving layers, and a peeling-off layer disposed between the two image receiving layers; and a rupturable pod containing a processing liquid, the processing pod being ruptured after exposure to discharge the processing liquid between the first sheet and the second sheet to form substantially identical positive images on the image receiving layers.

8. A diffusion transfer photographic film unit comprising:

a first sheet;

a second sheet including a first image receiving layer, a photosensitive layer, a second image receiving layer, a peeling-off layer disposed between the first image receiving layer and the second image receiving layer, and a white lining layer next to the first image receiving layer opposite the peeling-off layer; and a rupturable pod containing a processing liquid which is ruptured after exposure to discharge the processing liquid between the first sheet and the second sheet to form full color positive images in both the first image receiving layer and in the second image receiving layer.

* * * * *